US006865358B2

(12) United States Patent
Lee

(10) Patent No.: US 6,865,358 B2
(45) Date of Patent: Mar. 8, 2005

(54) METHOD AND APPARATUS FOR DRIVING A BELT

(75) Inventor: Beom-ro Lee, Suwon-si (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 12 days.

(21) Appl. No.: 10/409,606

(22) Filed: Apr. 9, 2003

(65) Prior Publication Data

US 2003/0219280 A1 Nov. 27, 2003

(30) Foreign Application Priority Data

Apr. 10, 2002 (KR) ..... 10-2002-0019475

(51) Int. Cl.[7] ..... G03G 15/00
(52) U.S. Cl. ..... 399/167; 399/165
(58) Field of Search ..... 198/806, 807, 198/810.03; 399/165, 116, 162, 312, 313, 329

(56) References Cited

U.S. PATENT DOCUMENTS 4,061,222 A * 12/1977 Rushing ..... 198/807
5,479,241 A * 12/1995 Hou et al. ..... 198/807
5,737,003 A 4/1998 Moe et al.
6,141,526 A * 10/2000 Ikeda ..... 399/162
2003/0129000 A1 * 7/2003 Lee et al. ..... 399/165

FOREIGN PATENT DOCUMENTS

JP 10231041 A * 9/1998 ..... B65H/5/02

* cited by examiner

*Primary Examiner*—Arthur T. Grimley
*Assistant Examiner*—Ryan Gleitz
(74) *Attorney, Agent, or Firm*—Sughrue Mion, PLLC

(57) ABSTRACT

A method and apparatus for driving a belt is provided. Included is a method and apparatus for searching for a home position of a steering roller for adjusting a position of the belt in a widthwise direction of the belt and placing the steering roller in the home position. The steering roller is moved from the home position to a balance point, in which an amount of variation of the belt in the widthwise direction is less than a predetermined value, or moved to a position of the steering roller that corresponds to a previously driven final position of the belt. The belt is driven in this state such that the amount of initial weaving of the belt is reduced. Thus, an amount of initial weaving of the belt when the belt is driven can be minimized such that a time to obtain images with suitable registration can be greatly reduced.

25 Claims, 14 Drawing Sheets

METHOD AND APPARATUS FOR DRIVING A BELT

BACKGROUND OF THE INVENTION

This application claims the priority of Korean Patent Application No. 2002-19475, filed Apr. 10, 2002, in the Korean Intellectual Property Office, the disclosure of which is incorporated herein in its entirety by reference.

1. Field of the Invention

Methods and apparatuses consistent with the present invention relate to a method and apparatus for driving a belt in a belt system, and more particularly, to a method and apparatus for driving a belt, in which an amount of initial weaving of a belt is reduced when the belt is driven.

2. Description of the Related Art

In general, a belt is used as a photoreceptor or transfer medium in electrophotographic image forming apparatuses such as printers, copiers, and facsimiles. This is because a belt requires a small volume and the need for spatial utilities is high. In particular, a belt is mainly used as a photoreceptor or transfer medium in multicolor image forming apparatuses. Specifically, when images of a multicolor toner are overlapped on a photoreceptor, a belt is mainly used as the photoreceptor. In addition, when images of multicolor toner are overlapped on a transfer medium, a belt is mainly used as the transfer medium. Also, when images of toner are transferred onto a recording medium such as paper, and the images are overlapped, a belt is mainly used as an apparatus for moving the recording medium. Also, a belt is used in an oil supplying apparatus of a fusing apparatus or a cleaning apparatus in electrophotographic image forming apparatuses. In the case of liquid electrophotographic image forming apparatuses, a belt is used in a drying apparatus.

In systems using a belt, weaving of a belt typically occurs when the belt is driven. In particular, weaving of a belt used as a photoreceptor or transfer medium in electrophotographic image forming apparatuses, such as printers, copiers, and facsimiles, is the chief factor of mis-registration by which images in a main scanning direction are not aligned to each other.

Weaving of the belt causes mis-registration in which the starting positions of lines are not aligned within one page. In addition, when color images are formed, color mis-registration in which color dots are not accurately overlapped with each other, can occur. Thus, in image forming apparatuses using a belt as a photoreceptor or transfer medium, the position of the belt in a main scanning direction (direction of a width) needs to be controlled so as to prevent weaving of the belt. This position control is referred to as steering control.

A home sensor that detects a home position is provided in belt steering systems, and is the basis of an operation of a steering roller that moves the belt in the main scanning direction.

FIG. 1 is a flowchart illustrating a conventional method of searching for a home of a steering roller. Referring to FIG. 1, in order to search for the home of the steering roller, the belt rotates and is driven, and a steering motor is driven such that the position of the steering roller is adjusted (S1)(S2). The position of the home of the steering roller is searched for using the home sensor while the steering motor is continuously driven (S3). If the home position of the steering roller is found, the operation of the steering motor stops such that a process of searching for the home of the steering roller stops (S4)(S5).

In the above-mentioned conventional method, the position of the steering roller is changed by driving the steering motor when the belt is driven, and thus the position of the belt, which rotates and is driven on the steering roller, is greatly changed. Thus, as shown in FIG. 2, when the steering motor for searching for the position of the home sensor is driven, the amount of initial weaving of the belt caused by the change of the position of the belt, which is in turn caused by movement of the steering roller, is increased. Thus, a great amount of time is needed to obtain registered images while steering control is performed.

SUMMARY OF THE INVENTION

It is an intention of the present invention to provide a method and apparatus for driving a belt for forming images, in which an amount of initial weaving of the belt is reduced when the belt is driven, such that registered images are obtained within a short time when the belt is driven.

Accordingly, to achieve the above intention, according to one non-limiting, illustrative embodiment of the present invention, there is provided a method for driving a belt. The method includes searching for a home position of a steering roller, the steering roller being operative to adjust a position of the belt in a widthwise direction. Further included is placing the steering roller in the home position; and moving the steering roller from the home position to a balance point so that an amount that the belt varies in the widthwise direction is less than a predetermined value, or moving the steering roller to a position that corresponds to a final position of the steering roller obtained when the belt was previously driven. Thus, an amount of initial weaving of the belt when the belt is driven is reduced.

It is contemplated that the belt is actively steered with respect to the balance point while the belt rotates and is driven.

It is also contemplated that the initial driving speed of a steering motor for searching for the position of the initial home of the steering roller is slower than the driving speed of the steering motor when the amount of weaving of the belt is controlled such that variations of position of the belt are reduced.

The method further provides for storing position information of the steering roller. In this case, it is contemplated that storing the position information of the steering roller is performed at predetermined time intervals while the belt is driven.

According to a further non-limiting aspect of the present invention, the method also provides comparing the final position information of the steering roller that corresponds to the previously driven position of the belt with the position of the home and determining the driving direction of the steering motor such that the amount of adjustment of the steering motor to place the steering roller in the home position is reduced.

Here, it is contemplated that a process of searching for the balance point is performed when a new belt is mounted in a belt system, the belt is replaced with another one, or the balance point is changed. In this case, it is also contemplated that when the average value for a predetermined amount of time of the step value of the steering motor does not vary within a predetermined error range, the position corresponding to the average value is determined as the balance point.

The belt includes a photoreceptor belt, a transfer belt, a drying belt, a fusing belt, or a returning belt.

According to an even further aspect of the invention, an apparatus for driving a belt is provided. The apparatus includes a steering roller that is operative to adjust a position of the belt in a widthwise direction; means for searching for a home position of the steering roller; and means for placing the steering roller in the home position. Also included is means for moving the steering roller from the home position to a balance point so that an amount that the belt varies in the widthwise direction is less than a predetermined value, or for moving the steering roller to a position that corresponds to a final position of the steering roller obtained when the belt was previously driven. Thus, an amount of initial weaving of the belt when the belt is driven is reduced.

The apparatus further provides means for actively steering the belt with respect to the balance point while the belt rotates and is driven; and means for storing position information of the steering roller. The storing of the position information of the steering roller may be performed at predetermined time intervals while the belt is driven.

Also contemplated with the apparatus is means for comparing the final position information of the steering roller that corresponds to the previously driven position of the belt with the home position and determining a driving direction of the steering motor such that the amount of adjustment of the steering motor to place the steering roller in the home position is reduced.

BRIEF DESCRIPTION OF THE DRAWINGS

The above aspects and advantages of the present invention will become more apparent by describing in detail non-limiting, illustrative embodiments thereof with reference to the attached drawings, in which.

DETAILED DESCRIPTION OF ILLUSTRATIVE, NON-LIMITING EMBODIMENTS OF THE PRESENT INVENTION

Figure 3:
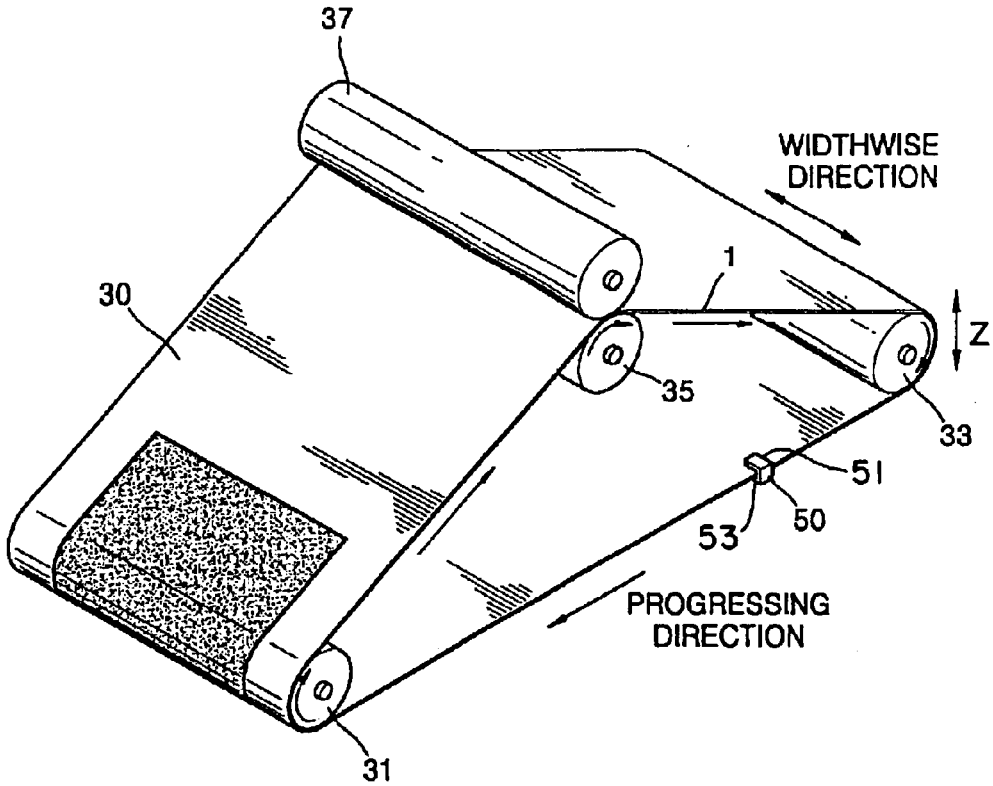
FIG. 3 is a perspective view schematically illustrating a non-limiting embodiment of a belt system in which a belt driving system according to the present invention is embedded.
Figure 4:
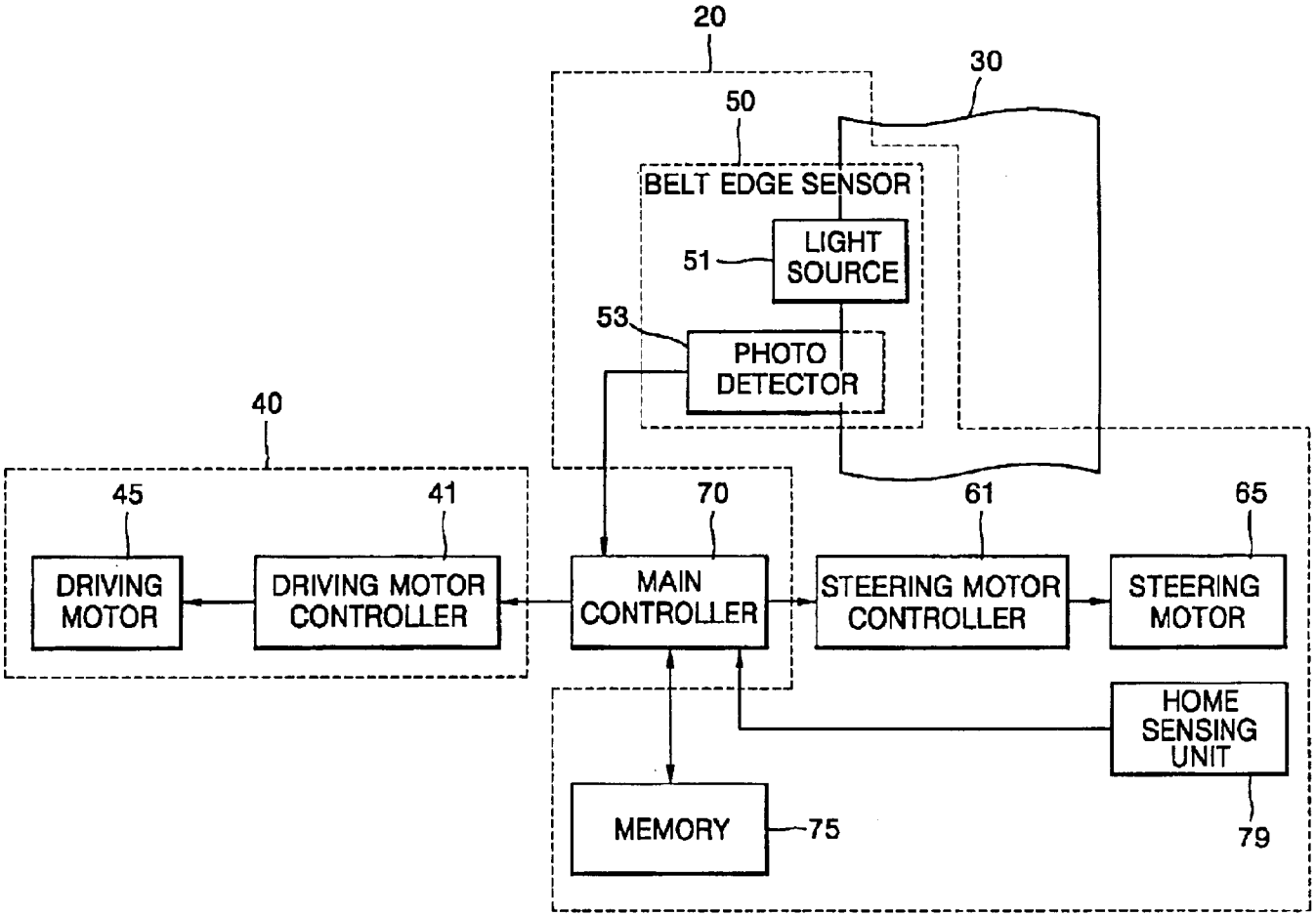
FIG. 4 is a block diagram illustrating a belt driving system according to a non-limiting embodiment of the present invention.
Figure 5:
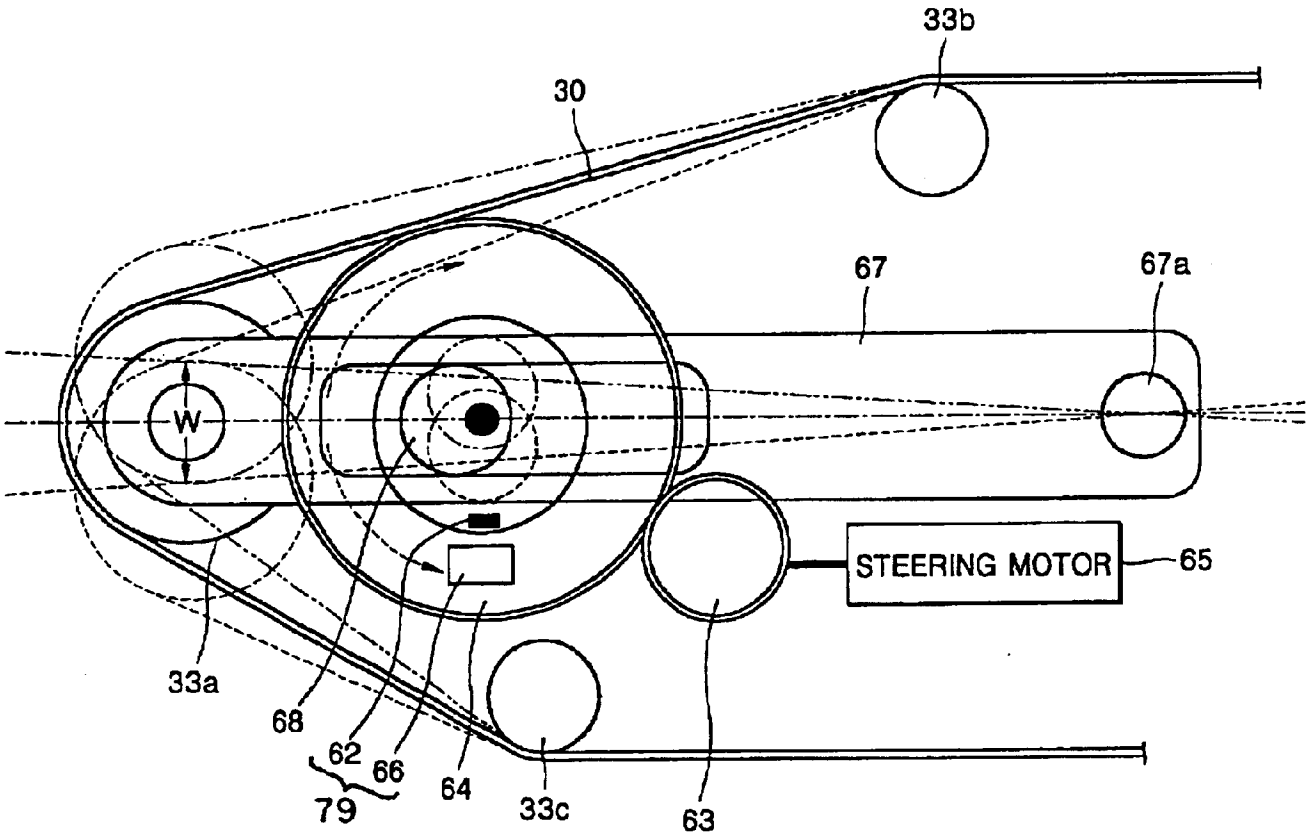
FIG. 5 is a schematic diagram of an example of a steering roller structure and a home sensing unit.

FIG. 3 is a perspective view schematically illustrating a belt system according to the present invention, FIG. 4 is a block diagram illustrating a belt driving system according to an illustrative embodiment of the present invention, and FIG. 5 is a schematic diagram of an example of a steering roller structure and a home sensing unit. As an example of a belt system, an image forming apparatus using a photoreceptor belt is shown in FIG. 3.

Referring to FIGS. 3 through 5, the belt driving system according to an embodiment of the present invention includes a belt driving mechanism 40 that drives a belt 30 such that the belt 30 travels in an endless track, an active steering system 20 that controls movement in the widthwise direction of the belt 30, for example, in the main scanning direction of a photoreceptor belt, and a main controller 70 that controls the belt driving system 40 and the active steering system 20. Here, as one skilled in the art would appreciate, the belt may be one of a photoreceptor belt, a transfer belt, a drying belt, a fusing belt, a returning belt, or the like.

The belt driving mechanism 40 includes a driving roller 31 that rotates and drives the belt 30, a driving motor 45 that provides a driving force to the driving roller 31, and a driving motor controller 41 that controls the driving motor 45.

The active steering system 20 includes a belt edge sensor 50 that detects a belt edge signal, a steering roller 33 that controls the position along the widthwise direction of the belt 30, and a steering motor 65 that drives the steering roller 33. Also included is a steering motor controller 61 that controls the steering motor 65, a home sensing unit 79 that detects the position of a home of the steering roller 33, and a memory 75. The memory 75 stores balance point data including a minimum amount of weaving of the belt 30 and/or a final position (or corresponding step value of the steering motor 65) of the steering roller 33 that corresponds to the previously driven position of the belt 30.

The belt edge sensor 50 includes a light source 51 and a photodetector 53, which is placed over at least one edge of the belt 30 such that an area where light emitted from the light source 51 is received and varied according to the position in the main scanning direction of the belt 30.

In one non-limiting embodiment, at least one light emitting diode (LED) is used for the light source 51 so that light can be irradiated over the edges of the belt 30. Alternatively, the light source 51 may be comprised of a LED array.

The steering roller 33 supports the belt 30, which can rotate and be driven by the belt driving mechanism 40, together with at least one roller, for example, the driving roller 31 and the guide roller 35. The belt 30 moves in the widthwise direction according to the movement of the steering roller 33.

With additional reference to FIG. 5, the steering roller 33 is installed to move and be interlocked by the operation of a cam structure driven by the steering motor 65. The cam structure includes a pivoting lever 67 and a cam 68. The pivoting lever 67 pivots with respect to a pivoting axis 67*a* by rotation of the cam 68 and is coupled to the main steering roller 33*a* so as to move the main steering roller 33*a*. The cam 68 is installed in a second gear 64 coupled to a first gear 63, which rotates and is driven by the steering motor 65.

The main steering roller 33*a* is interlocked with the cam 68 by means of the pivoting lever 67 that pivots with respect to the pivoting axis 67*a*. In FIG. 5, reference character W denotes the maximum movement width of the main steering roller 33*a*. FIG. 5 illustrates an example in which the steering roller 33 is comprised of the main steering roller 33*a* and a pair of assistant steering rollers 33*b* and 33*c*. Thus, the steering roller 33 in FIG. 3, can be replaced with the elements shown in FIG. 5. It will be appreciated that the pivot lever only moves one portion of the main steering roller 33*a* in the "Z" direction, as shown in FIG. 3. This causes a portion of the main steering roller 33*a* to become offset in the horizontal direction. The assistant steering rollers 33*b* and 33*c* function to prevent the belt from being distorted and wrinkled by movement of the main steering roller 33*a*. Also, the assistant steering rollers 33*b* and 33*c* function to limit variation of the belt due to movement of the main steering roller 33*a* to the position of the assistant steering rollers 33*b* and 33*c*.

As shown in FIG. 5, a home sensing unit 79 includes a mark 62 and a home sensor 66 that recognizes the mark 62. The mark 62 and the home sensor 66 are provided so that the mark 62 is detected by the home sensor 66 when the steering roller 33 is placed in the position of the home, or home position, for example, the main steering roller 33*a* is placed at the center of the maximum movement width W. It can be seen from FIG. 5 that the mark 62 is formed in the second gear 64 and the home sensor 66 is placed opposite to the mark 62 when the main steering roller 33*a* is placed in the home position. Since the mark 62 actually has some width, the position of the home of the main steering roller 33*a* can be determined as the position in which a detection signal from a time when the recognition of the mark 62 by the home sensor 66 starts to a time when the recognition of the mark 62 ends, is divided equally and is counted by using a circuit. The counted number is then divided in half. Here, the home sensing unit 79 may be provided so as to detect the position of the home of the steering roller 33 by a photodetection method. That is, the mark 62 may be formed to reflect light, the home sensor 66 may be comprised of a light source from which light is irradiated, and a photodetector that detects the mark 62 by receiving light irradiated from the light source and reflected by the mark 62. Alternatively, another detection method may be used in the home sensing unit.

When the belt 30 is actively steered using the active steering system 20 used in the belt driving system according to the present invention, the position of the home of the steering roller 33 is used as a reference point (zero point). That is, if the steering roller 33 is placed at a balance point where the amount of the position variation in the widthwise direction of the belt 30 is less than a predetermined value and the belt 30 is steered with respect to the balance point when the belt 30 is driven, the amount of weaving of the belt 30 can be minimized. This balance point data may be obtained with respect to the position of the home of the steering roller 33. Thus, the process of detecting the home position of the steering roller 33 produces information which is important when the belt 30 is driven.

The balance point data (substantially, a step value of the steering motor 65 corresponding to the balance point) is stored in the memory 75. In this case, the step value of the steering motor 65 corresponding to the balance point can be obtained on the basis of a step value of the steering motor 65 when the steering roller 33 is placed in the home position. In addition, it is contemplated that the memory 75 stores, for example, the final position of the steering roller 33, which corresponds to the previously driven position of the belt 30 together with steering control; the position (the final position of the steering roller 33 when the belt 30 is driven during the next time) of the steering roller 33 when the belt 30 is driven and then stops; and step values of the steering motor 65 corresponding to the positions Since the positions of the steering roller 33 and the corresponding step values of the steering motor 65 may have substantially the same meaning, the positions of the steering roller 33 can be taken to mean the corresponding step values of the steering motor 65, and conversely, the step values of the steering motor 65 can be taken to mean the corresponding positions of the steering roller 33. It is noted that the memory 75 may be embedded in the main controller 70 or may be provided separately.

In the belt driving system having the above structure according to the present invention, as will be described later, the active steering system 20 can minimize the amount of weaving of the belt 30 by steering the belt 30 on the basis of a balance point in which the belt 30 is most stably driven. Thus, in an image forming apparatus using the same, images may be stably obtained without an additional registration correction circuit. In addition, as will be described later, the active steering system 20 can actively search for the balance point, which serves as the basis for steering to minimize the amount of weaving of the belt 30.

According to an illustrative embodiment of the present invention, the main controller 70 controls the entire operation of the belt driving system. That is, the main controller 70, as will be described later, controls the belt driving system such that the amount of initial weaving of the belt 30 is greatly reduced. In addition, the main controller 70 controls the driving motor controller 41 and/or the steering motor controller 61 such that the belt 30 is steered with respect to the balance point, using the belt edge signal detected by the belt edge sensor 50, and thus the amount of weaving of the belt 30 is minimized when the belt 30 rotates and is driven.

In the belt driving system having the above structure according to the present invention, a control algorithm for driving the belt 30 so as to reduce the amount of initial weaving of the belt 30 when the belt 30 is driven will be described below.

Figure 6:
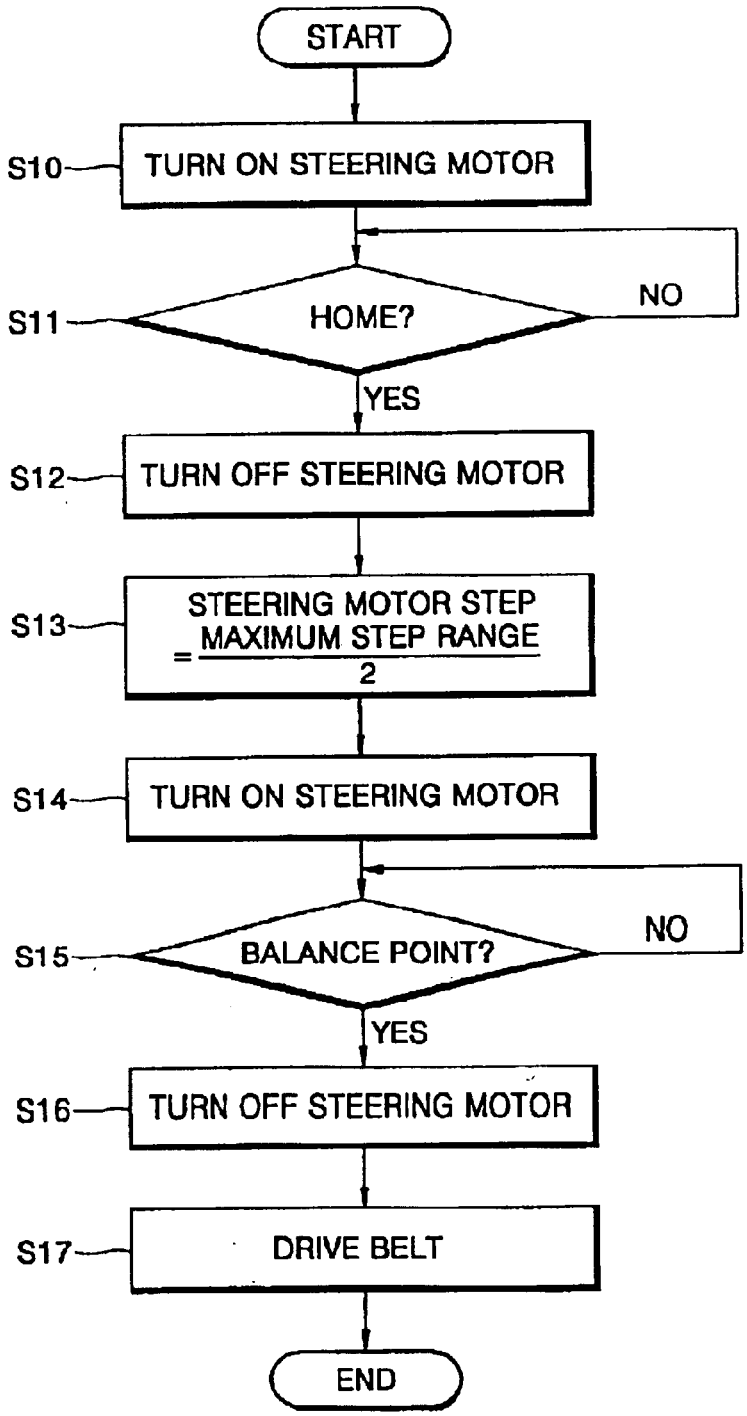
FIG. 6 is a flowchart illustrating a non-limiting first embodiment of a method for driving a belt according to the present invention.

FIG. 6 illustrates a non-limiting first embodiment of a method for driving a belt according to the present invention.

In FIG. 6, it is represented that the belt 30 is driven when the steering roller 33 is placed at the balance point where the amount of weaving of the belt 30 is minimized.

Referring to FIG. 6, when the main controller 70 gives instructions to drive the belt 30, before the belt 30 rotates and is driven, the steering motor controller 61 drives the steering motor 65 (S10) and the home position of the steering roller 33 is searched for using a detection signal of the home sensor 66 (S11).

If the home position of the steering roller 33 is searched for, the present step value of the steering motor 65 is set to half of the number of maximum available steps (S13). The home position of the steering roller 33 is the reference point (zero point) of operation for the steering roller 33. Here, the step (S13) may be omitted.

After that, the steering motor 65 is driven such that the steering roller 33 is moved to the balance point where the belt 30 most stably rotates and is driven (S15). That is, the step value of the steering motor 65 is moved to the number of steps corresponding to the balance point where the belt 30 most stably rotates and is driven. Information on the balance point is stored in the memory 75.

After that, the driving motor controller 41 drives the driving motor 45 such that the belt 30 is driven in a progressing direction (S17). While the belt 30 rotates and is driven, as will be described later, the active steering system 20 controls the movement in the widthwise direction of the belt 30.

In FIG. 6, steps (S12 and S16) for stopping driving of the steering motor 65 between step (S11) for searching for the home of the steering roller 33 and step (S17) for driving the belt 30, and step (S14) for driving the steering motor 65 are necessary when a series of operations are discontinuously performed. But, these may be omitted when the series of operations are continuously performed.

When the balance point data where the amount of weaving of the belt 30 in the belt system according to the present invention is minimized is not stored in the memory 75 or a new balance point is detected due to varied conditions of the belt system, the steering roller 33 is placed in the home position, and then a process for searching for the balance point where the amount of weaving of the belt 30 is minimized can be performed. Here, variations of the conditions of the belt system may include, for example, mounting of a new belt, replacing the belt, and changing a balance point.

In the method for driving a belt according to the first embodiment of the present invention described with reference to FIG. 6, while the belt 30 is not driven, the steering motor 65 is driven and the home position of the steering roller 33 is searched for using the home sensing unit 79. The steering roller 33 is then moved to the balance point obtained on the basis of the home, and the belt 30 is driven. Thus, the amount of initial weaving of the belt 30 is remarkably reduced compared to prior arts.

Figure 7:
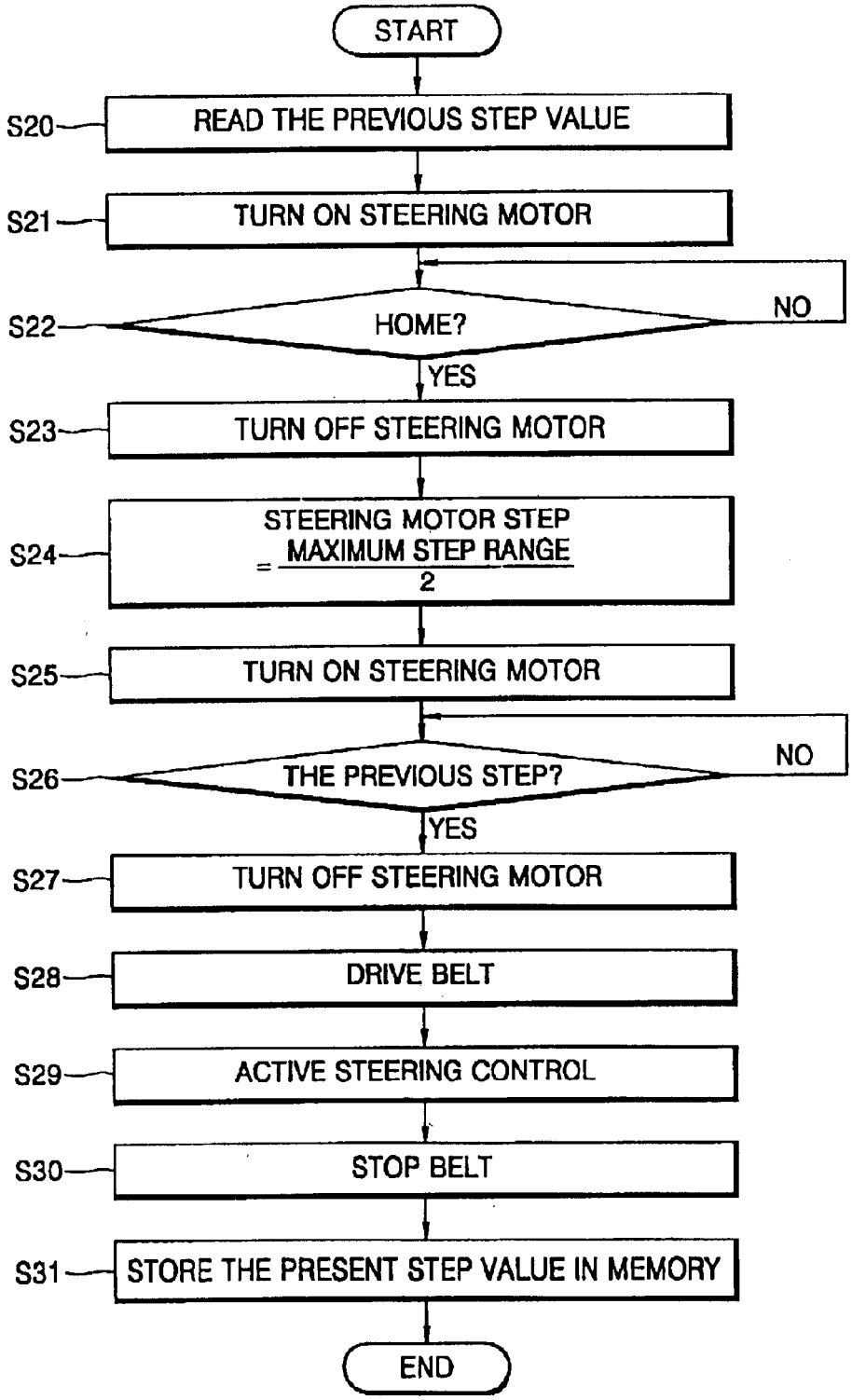
FIG. 7 is a flowchart illustrating a non-limiting second embodiment of a method for driving a belt according to the present invention.

FIG. 7 is a flowchart illustrating a second non-limiting embodiment of a method for driving a belt according to the present invention. In FIG. 7, it is described that the steering roller 33 is placed in a position corresponding to the final position of the steering roller 33 that was stored in the memory when the belt 30 was previously driven. The belt 30 is then driven.

Referring to FIG. 7, according to the second embodiment of the present invention, if the main controller 70 instructs driving of the belt 30, before the belt 30 is driven, the steering motor controller 61 first drives the steering motor 65 (S21) and the home position of the steering roller 33 is searched for using a detection signal of the home sensor 66 (S22).

If the home position of the steering roller 33 is searched for, the present step value of the steering motor 65 is set to half of the number of maximum available steps (S24). As with the first embodiment, the home position of the steering roller 33 is the reference point (zero point) of operation for the steering roller 33. Here, the step (S24) may be omitted.

The previous step value of the steering motor 65 representing the previous final position of the steering roller 33 is read from the memory 75 (S20). The steering motor 65 is driven such that the step value of the steering motor 65 is moved to the previous step value read from the memory 75 and the steering roller 33 is moved to the final position that corresponds to the previously driven position of the belt 30 (S26). In FIG. 7, an operation (S20) for reading the previous step value from the memory 75 is performed before an operation for placing the steering roller 33 in the home position. The operation (S20) is performed only before step (S26) of moving the steering roller 33 to the previous final position of the steering roller 33.

After that, the driving motor controller 41 drives the driving motor 45 such that the belt 30 is driven in a progressing direction (S28). While the belt 30 rotates and is driven, as will be described later, the active steering system 20 controls movement in the widthwise direction of the belt 30 (S29).

If the belt 30 stops (S30), the step value of the steering motor 65 corresponding to the position of the steering roller 33 is stored in the memory 75 (S31). The step value of the steering motor 65 corresponding to the present position of the steering roller 33 stored in the memory 75 is used as the previous step value corresponding to the final position of the steering roller 33 that corresponds to the previously driven position of the belt 30, when the belt driving system next operates.

Here, position information of the steering roller 33 may be stored in the memory 75 at predetermined time intervals while the belt 30 is driven. Likewise, if the present position information of the steering roller 33 is stored in the memory 75 at predetermined time intervals, even when the operation of the belt driving system abnormally stops, the final position information of the steering roller 33 that corresponds to the previously driven position of the belt 30, is stored in the memory 75. Hence, belt driving is performed by the control algorithm according to the second embodiment of the present invention described with reference to FIG. 7.

In FIG. 7, steps (S23)(S27) for stopping driving of the steering motor 65 between step (S22) for searching for the home of the steering roller 33 and step (S28) for driving the belt 30, and step (S25) for driving the steering motor 65 are necessary when a series of operations are discontinuously performed. But, these may be omitted when the series of operations are continuously performed.

In the method for driving a belt according to the second embodiment, when the balance point data where the amount of weaving of the belt 30 in the belt system is minimized, is not stored in the memory 75, or a new balance point must be detected due to varied conditions of the belt system, as with the first embodiment, the steering roller 33 is placed in the home position, and then a process for searching for the balance point where the amount of weaving of the belt 30 is minimized, can be performed.

In the method for driving a belt according to the second embodiment of the invention, the final position of the steering roller 33 that corresponds to the previously driven position of the belt 30, is used as a reference position of the steering roller 33 for the belt 30 in the present. Thus, variations of conditions of the belt system can be confirmed. Here, when the step value of the steering motor 65 is set to the previous step value corresponding to the final position of the steering roller 33 and the belt 30 is actively steered and is driven, the previous step value corresponds to a step value while the belt 30 was steered such that the amount of weaving of the belt 30 that corresponds to the previously driven of the belt 30, is minimized. Accordingly, variations of conditions of the belt system can be confirmed because if conditions of the belt system are not changed, the amount of weaving of the belt 30 is small, and on the contrary, if conditions of the belt system are changed, the amount of weaving of the belt 30 will be large.

As described with reference to FIGS. 6 and 7, if the steering motor 65 is driven so as to search for the position of the home of the steering roller 33, even though the belt 30 is not driven, the position of the belt 30 may be changed according to variations in the position of the steering roller 33.

Figure 8:
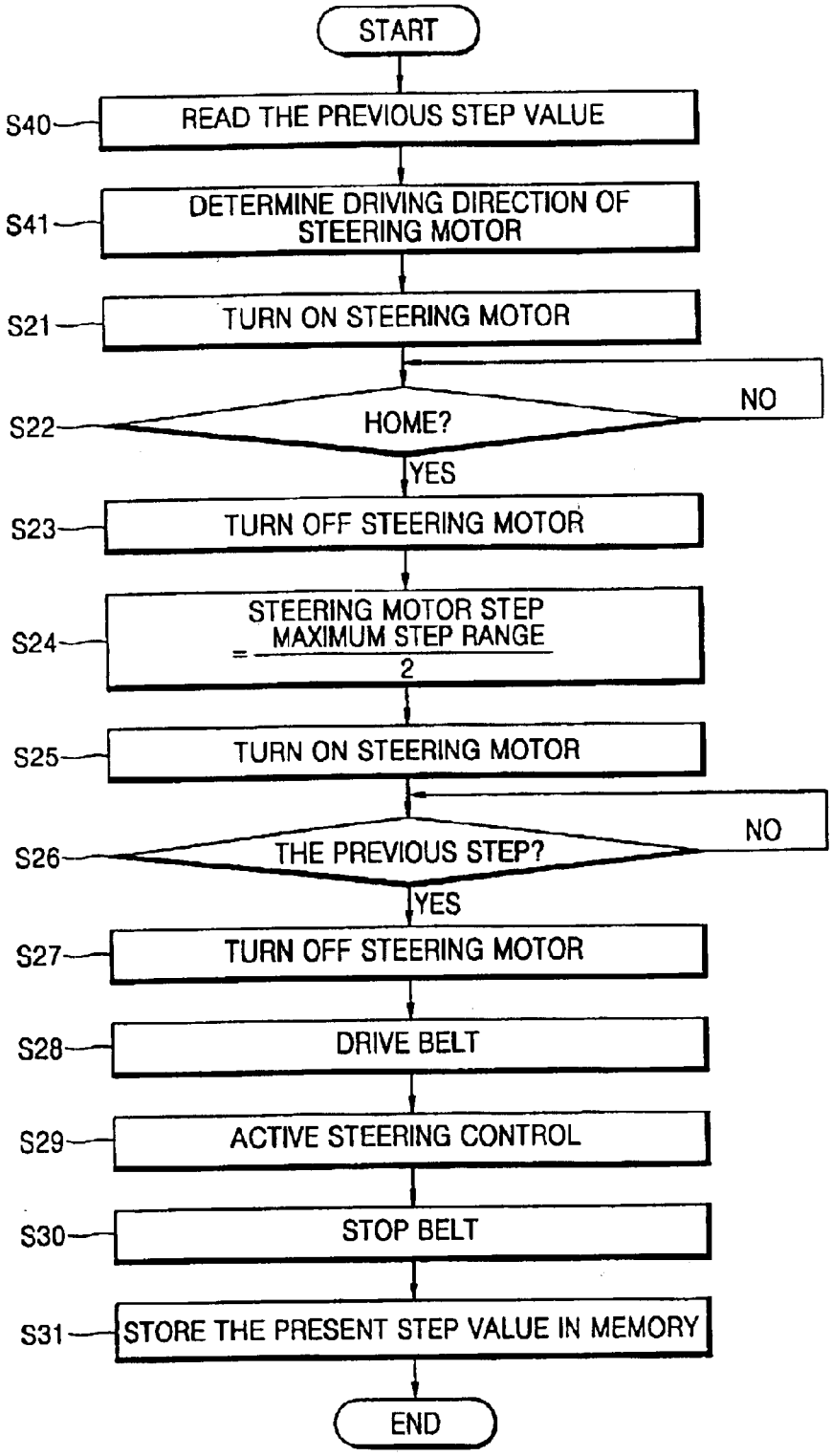
FIG. 8 is a flowchart illustrating a non-limiting third embodiment of a method for driving a belt according to the present invention.

Thus, as shown in FIG. 8, a control algorithm for reducing the amount of adjustment of the step value of the steering motor 65 required to search for the home of the steering roller 33 is used such that variations in the position of the belt 30 are minimized by minimizing driving of the steering motor 65 and variations in the position of the steering roller 33 for searching for the position of the home of the steering roller 33.

Referring to FIG. 8, the previous step value of the steering motor 65 corresponding to the final position of the steering roller 33 is read from the memory 75 such that the amount of adjustment of the step value of the steering motor 65 is reduced until the position of the home of the steering roller 33 is searched for (S40). The final position of the steering roller 33 stored in the memory 75 is compared with the position of the home, and the driving direction of the steering motor 65 is determined (S41). That is, the previous step value is compared with the step value of the steering motor 65 when the steering roller 33 is placed in the home position, and the driving direction of the steering motor 65 is determined such that the amount of adjustment of the step value of the steering motor 65 required until the steering roller 33 is placed in the home can be reduced. If information on the home position of the steering roller 33 and/or the corresponding position of the step value of the steering motor 65 is stored in the memory 75, even if the actual position of the home of the steering roller 33 does not exactly coincide with data stored in the memory 75, the actual position of the home of the steering roller 33 is near the data stored in the memory 75. Thus, the driving direction of the steering motor 65 that can reduce the amount of adjustment of the steering motor 65 can be determined.

After that, while the steering motor 65 is driven in the determined driving direction, a process of placing the steering roller 33 in the home position is performed. Subsequent processes are the same as described with reference to FIG. 7.

Figure 1:
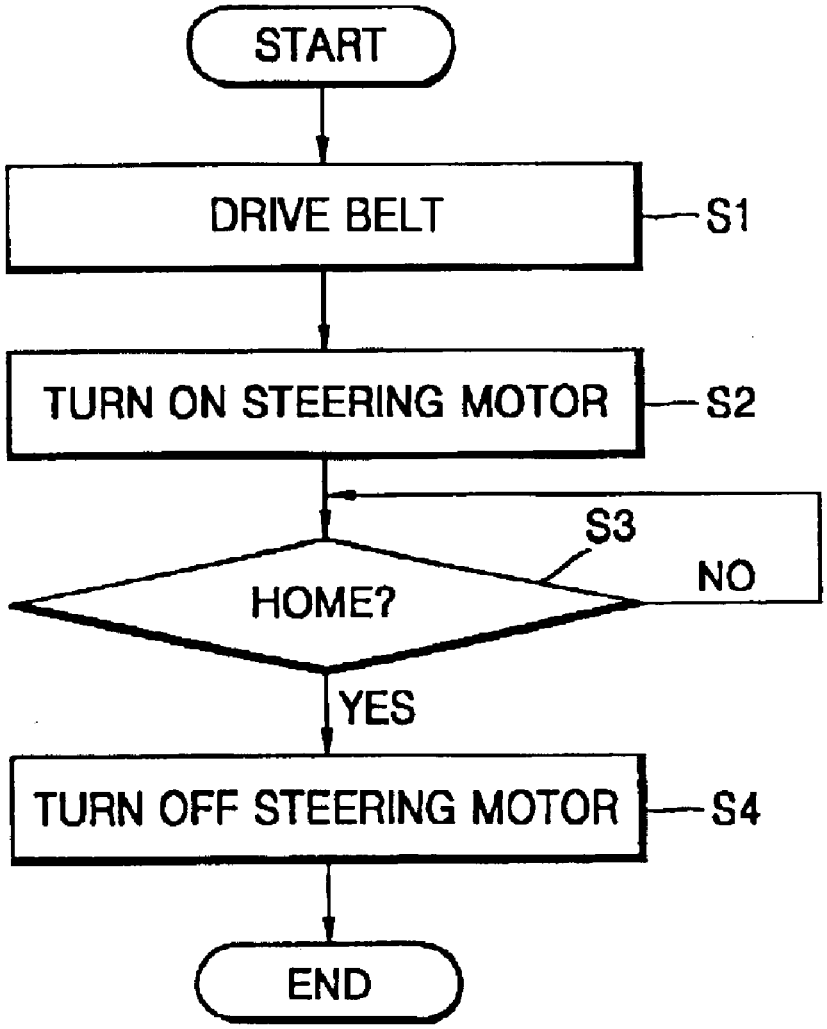
FIG. 1 (PRIOR ART)
FIG. 1 is a flowchart illustrating a conventional method for searching for the position of a home of a steering roller.
Figure 2:
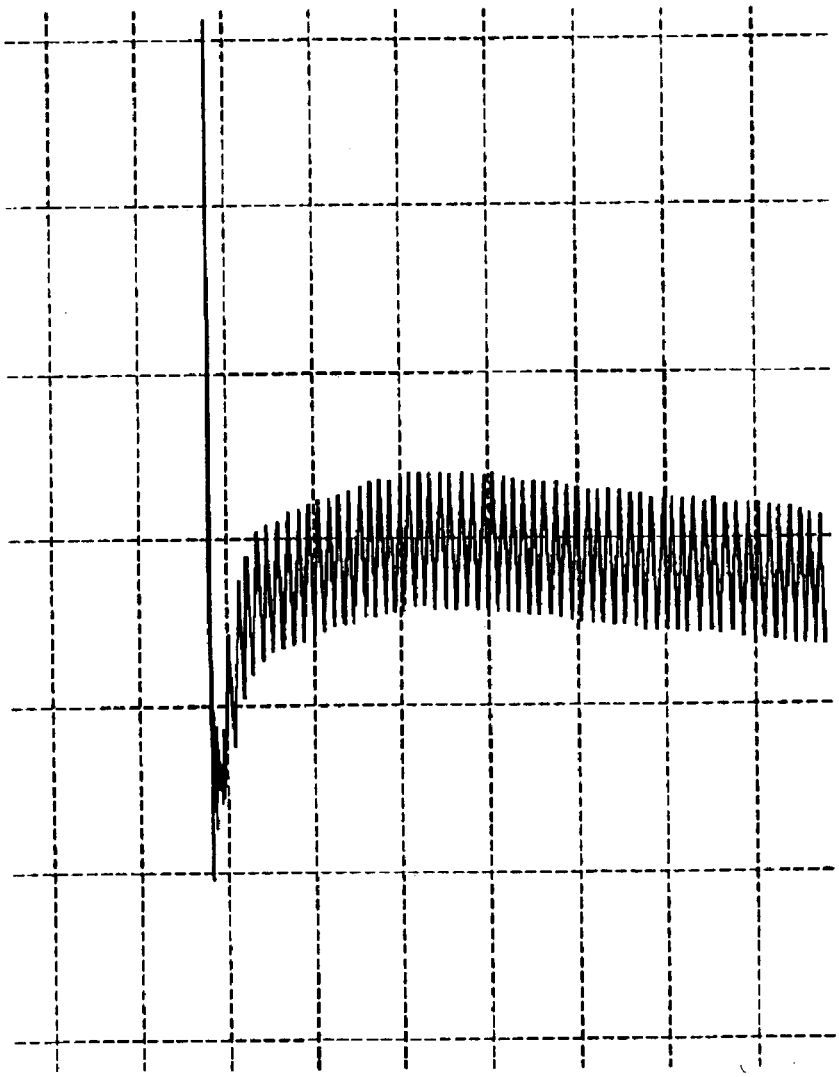
FIG. 2 (PRIOR ART)
FIG. 2 is a graph illustrating the amount of initial weaving of a belt after the position of the home of the steering roller is searched for using the conventional method shown in FIG. 1.
Figure 9:
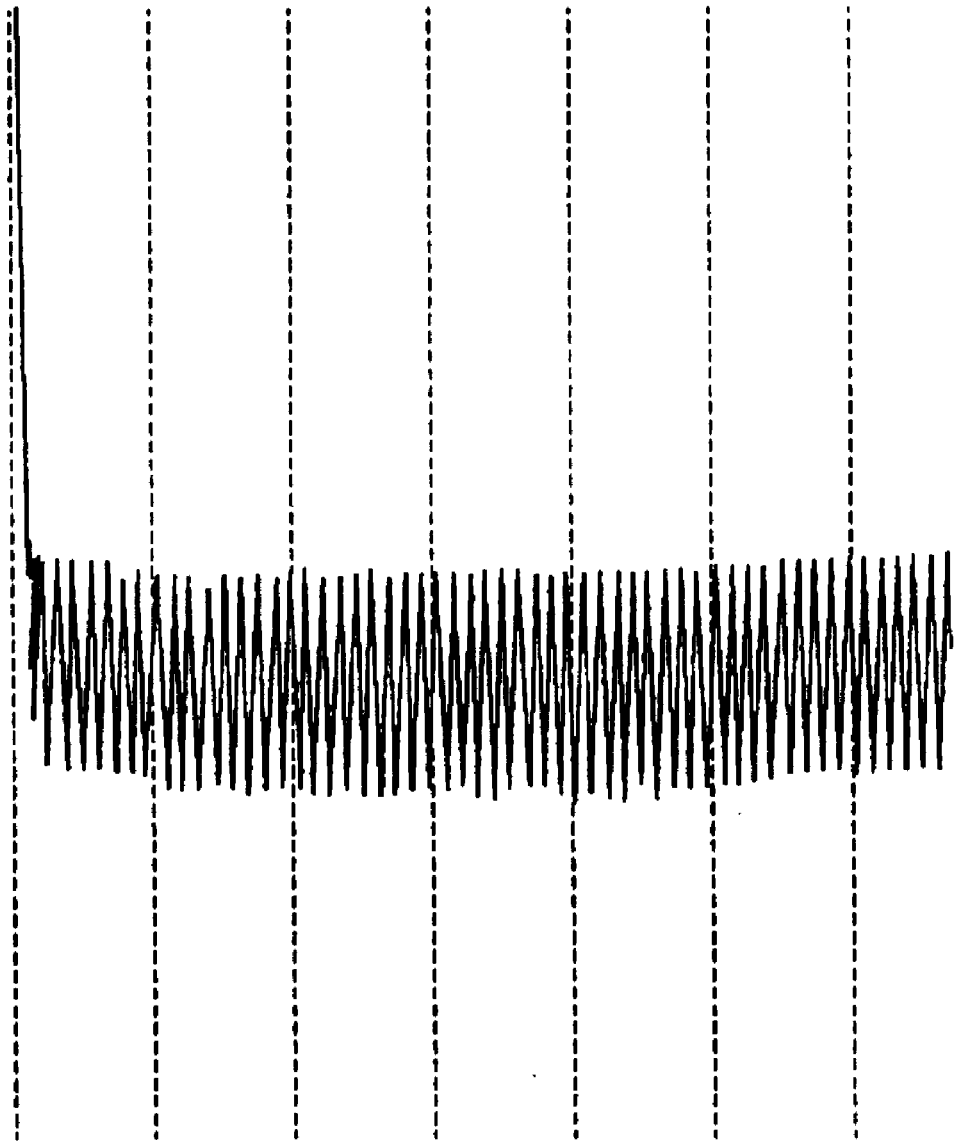
FIG. 9 is a graph illustrating the amount of initial weaving of the belt when the method for driving a belt according to the third embodiment of the present invention in FIG. 8 is used.

FIG. 9 is a graph illustrating the amount of weaving of the belt 30 when a method for driving a belt according to the third embodiment of the-present invention shown in FIG. 8 is used. Comparing FIG. 2, which illustrates the amount of initial weaving of a belt after the position of the home of the steering roller is searched for using the conventional method, with FIG. 9, the amount of initial weaving of the belt 30 is remarkably reduced using the method for driving a belt according to the present invention.

In the present invention, as described above, in order to reduce variations of the position of the belt 30, the initial driving speed of the steering motor 65 when searching for the position of the initial home position of the steering roller 33 is slower than when the amount of weaving of the belt 30 is controlled. The slower the driving speed of the steering motor 65, the smaller the variations of the position of the belt 30 caused by variations of the steering roller 33. Additionally, the material of the steering roller 33 may be replaced with a material having a large coefficient of friction so that the belt 30 does not easily slip.

In the method for driving a belt according to the present invention, the home position of the steering roller 33 is searched for using the home sensing unit 79 when the belt 30 is not driven, and then the steering roller 33 is placed in the home position. After that, the step value of the steering motor 65 is moved from the step value corresponding to the home to the step value of the steering motor 65 corresponding to the balance point where the amount of weaving of the belt 30 is minimized, or one step value of the final step values of the steering motor 65 that corresponds to the previously driven step value of the belt 30. The belt 30 then rotates and is driven. Thus, the amount of initial weaving of the belt 30 when the belt 30 is driven can be remarkably reduced compared with the prior art.

Thus, according to the present invention, weaving of the belt 30 caused by variations of the belt 30 caused by the operation for searching for the initial reference position (home) of the steering roller 33 before the belt 30 is driven can be prevented.

Hereinafter, a method for searching for a balance point where the amount of weaving of the belt 30 is minimized and a method for actively steering the belt 30 on the basis of the balance point in the active steering system used in the belt driving system according to the present invention will be described.

Figure 10:
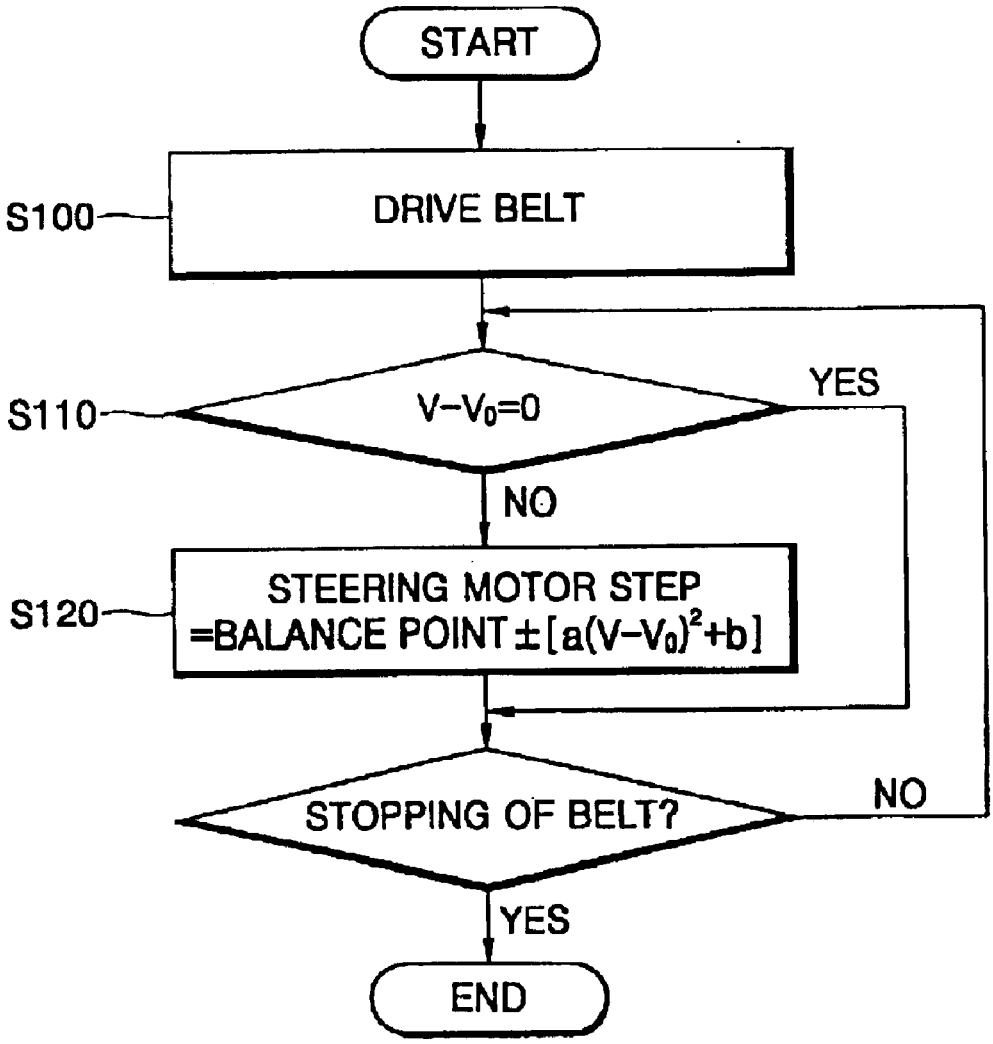
FIG. 10 is a flowchart of a non-limiting embodiment of an active steering method based on a balance point, using an active steering system used in the belt driving system according to the present invention.

FIG. 10 illustrates a non-limiting embodiment of a method for actively steering the belt 30 on the basis of a balance point using an active steering system 20 used in the belt driving system according to the present invention. Referring to FIG. 10, the steering motor controller 61 drives the steering motor 65 to move the steering roller 33 to the balance point, and the driving motor controller 41 drives the driving motor 45 to drive the belt 30 in a progressing direction (S100).

Here, when a new belt is mounted in a belt system or the belt is replaced with another one or the balance point is changed, the active steering system 20 according to the present invention obtains the balance point with respect to the state of the present belt system, and then the belt 30 is steered on the basis of the balance point obtained.

If the belt 30 rotates and is driven, a belt edge signal proportional to the degree in which the belt 30 shields the photodetector 53 of the belt edge sensor 50 is generated. The belt edge signal is input into the main controller 70. At the main controller 70, the inputted belt edge signal V is compared with a reference belt edge signal $V_o$ (S110). The reference belt edge signal $V_o$ is a belt edge signal that is detected when the edge of the belt 30 is placed at a predetermined position with reference to the photodetector 53, which in one embodiment, is the center of the photodetector 53, while the steering roller 33 is placed in the balance point.

In step S120, the belt edge signal V is compared with the reference belt edge signal $V_o$. If the size of the belt edge signal V is the same as the size of the reference belt edge signal $V_o$ (this means that the size of the belt edge signal V is the same as the size of the reference belt edge signal $V_o$, within an allowable error range), the belt 30 rotates and is driven while the state of the belt 30 is maintained. If not the same, the step value of the steering motor 65 is determined according to the degree in which the edge of the belt 30 is deviated from the center of the photodetector 53, the steering motor 65 is moved to the step value, and the position in the widthwise direction of the belt 30 is adjusted. While the belt 30 rotates and is driven, the above step is repeatedly performed such that the position in the widthwise direction (the main scanning direction of the photoreceptor belt or transfer belt in the image forming apparatus) of the belt 30 is controlled.

When the belt 30 is steered on the basis of the balance point, driving of the steering motor 65 required to determine the step value of the steering motor 65 according to a degree in which the edge of the belt 30 is deviated from the center of the photodetector 53 is performed according to the following principle.

The steering motor 65 may be driven in a predetermined step interval or in a step interval in which the relationship between the belt edge signal and a step value of the steering motor 65 (that is, the relationship of the position of the steering roller 33 according to the position of the belt 30 on the photodetector 53) satisfies a quadratic functional equation.

Figure 11:
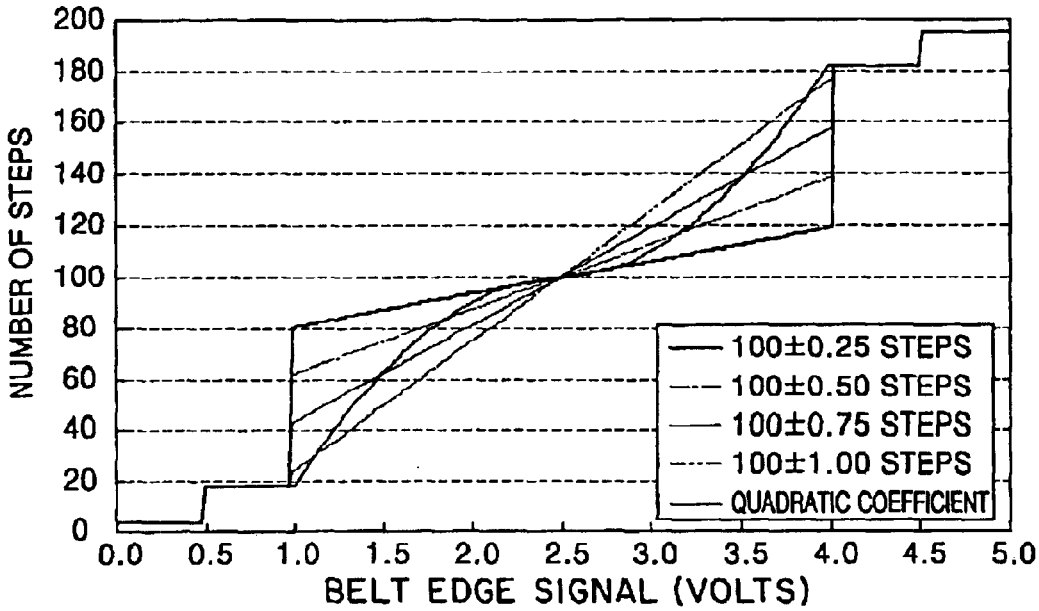
FIG. 11 is a graph illustrating the relationship between a belt edge signal detected by a belt edge sensor according to a driving step interval of a steering motor and a step position (represented as the number of steps) of the steering motor.

FIG. 11 illustrates the relationship between a belt edge signal detected by a belt edge sensor according to a driving step interval of the steering motor 65 and a step position (represented as the number of steps) of the steering motor 65. In FIG. 11, the range of a controllable step value of the steering motor 65 is 0 to 200 steps (rotatable at −90°–+90°), and when the step value of the steering motor 65 is 100, the controllable step reaches the maximum value. As an example, if the balance point of the steering roller 33 is 100 steps, when the edge of the belt 30 is placed at the center of the photodetector 53, the step value of the steering motor 65 is 100. In this case, if the belt 30 moves 0.1 mm in the widthwise direction, the belt edge signal varies 0.1 Volts. As shown in FIG. 11, if the belt edge signal is detected to deviate from the reference belt edge signal $V_o$ to a predetermined value, the step value of the steering motor 65 varies depending on which step interval the steering motor 65 is controlled.

Referring to FIG. 11, when the steering motor 65 is driven in a predetermined step interval, i.e., in a step interval of ±0.75, for example, if a belt edge signal (V=2.0 Volts or 3.0 Volts) is detected to deviate from 2.5 Volts to 0.5 Volts is detected, the step value of the steering motor 65 should be moved to 19.25 (0.5×51×0.75) steps (or 17.325°) from the balance point. On the other hand, when the steering motor 65 is driven (corresponds to a quadratic coefficient graph in FIG. 11) in a step interval in which the relationship between the belt edge signal and a step value of the steering motor 65 (that is, the relationship of the position of the steering roller 33 according to the position of the belt 30 on the photodetector 53) satisfies a quadratic functional equation, for example, if a belt edge signal is detected to deviate from 2.5 Volts to 0.5 Volts is detected, the step value of the steering motor 65 moves 10.5 steps (9.45°) from the balance point.

Figure 12:
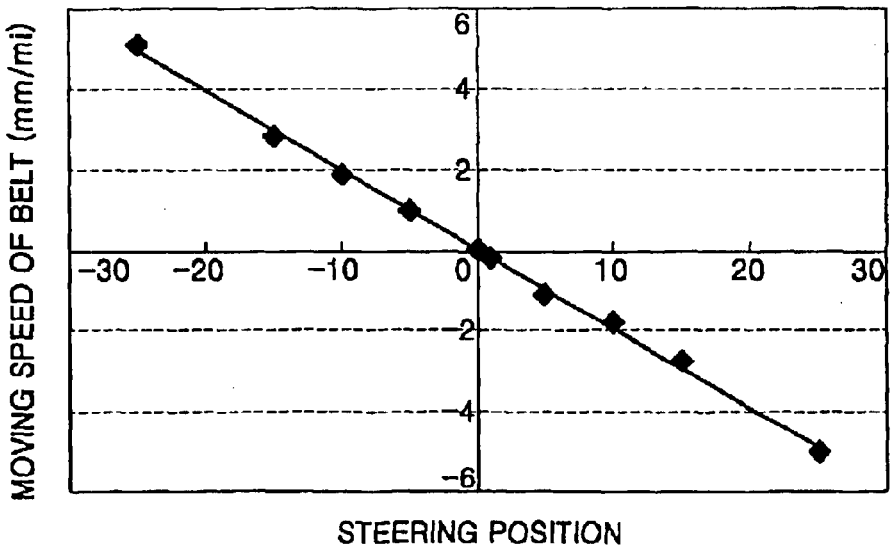
FIG. 12 is a graph illustrating the moving speed of the belt in a main scanning direction according to a steering position on the basis of a balance point in the active steering system used in the belt driving system according to the present invention.

FIG. 12 is a graph illustrating moving speed of the belt 30 in a main scanning direction according to a steering position on the basis of a balance point in the active steering system 20 used in the belt driving system according to the present invention. Here, the graph of FIG. 12 shows that if the step value of the steering motor 65 is moved 10 steps with reference to the balance point, the belt 30 moves at the speed of 2 mm/min in the central direction, and if the step value of the steering motor 65 is moved 20 steps with reference to the balance point, the belt 30 moves at a speed of 4 mm/min. That is, if the state of moving 20 steps with reference to the balance point is maintained, the belt 30 moves from one end to the other end of the photodetector 53 in 1.25 minutes.

As shown in FIG. 12, since the steering position and the moving speed of the belt 30 are proportional to each other, even when the steering motor 65 is driven in a predetermined step interval, the position of the main scanning direction of the belt 30 can be adjusted.

As shown in FIG. 12, as the steering position further deviates from the balance point, the moving speed of the belt 30 increases. Thus, as the step range of the steering motor 65 is large, the maximum value of the moving speed of the belt 30 increases.

However, when the step interval in which the steering motor 65 is driven is constant, if the steering motor 65 is driven in a small step interval, i.e., in a step interval of 100±0.25 being applied to the graph of 100±0.25 step shown in FIG. 11, since the used step range is small, it takes more time for the belt 30 to move from an edge of the photodetector 53 to the center thereof. In FIG. 11, when the steering motor 65 is driven in the step interval of ±0.25, the step range is about 80–120 steps, and thus not all steps of the steering motor 65 are used.

As known above, when the driving step interval of the steering motor 65 is small, the step range is small, and thus it is difficult to quickly move the belt 30 in the widthwise direction. Thus, it is improper for the steering motor 65 to be driven in a small step interval when the weaving of the belt 30 is large.

Also, if the steering motor 65 is driven in a large step interval, i.e., in a step interval of 100±1.00 being applied to the graph of 100±1.00 step shown in FIG. 11, a sufficient step range can be used. However, since the step interval is large, the moving speed of the belt 30 is large, and thus it can be difficult to perform belt steering with respect to small weaving of the belt 30 near the balance point.

Thus, the active steering system 20 according to the present invention drives the steering motor 65 near the balance point in a small step interval. This takes into consideration the degree where the step value of the steering motor 65 is deviated from the step value corresponding to the balance point is proportional to the moving speed of the belt 30 such that the position in the widthwise direction of the belt 30 moves slowly. Also, as the step value of the steering motor 65 becomes more distant from the balance point, the active steering system 20 drives the steering motor 65 in a large step interval such that the position in the widthwise direction of the belt 30 moves quickly.

That is, in the active steering system 20 according to the present invention, it is preferable that the steering motor 65 is driven in a step interval of the quadratic coefficient graph as shown in FIG. 11, in which the relationship between the belt edge signal and the step value of the steering motor 65 satisfies a quadratic functional equation. If the step value of the steering motor 65 is adjusted with the quadratic functional equation (steering motor step value=balance point±[a $(V-V_o)^2+b$]), as shown in FIG. 10, when the amount of weaving of the belt 30 is large because the step value of the steering motor 65 is far from the balance point, the steering motor 65 is driven in a larger step interval. Thus, the adjustment of the step value is performed quickly, and the belt 30 moves quickly to the balance point (center of the photodetector 53). Near the balance point in which the amount of weaving of the belt 30 is small, the steering motor 65 is driven in a smaller step interval. Thus, the adjustment of the step value is performed slowly, and the adjustment of the position of the belt 30 is performed slowly. Since the belt 30 moves to the balance point in the widthwise direction at high speed and moves slowly near the balance point, the belt 30 reaches near the balance point within a small amount of time. When the belt 30 is controlled with respect to the balance point, the amount of weaving of the belt 30 greatly decreases. Thus, weaving of the belt is minimized, and optimal belt steering can be performed.

Here, the quadratic function graph of the step value of the steering motor 65 with respect to the belt edge signal shown in FIG. 11 illustrates a case where the step value of the steering motor 65 corresponding to the balance point is 100 steps when the reference belt edge signal $V_o$ is 2.5 Volts in the step equation of the steering motor 65 shown in FIG. 10. In FIG. 10, coefficient a of the binomial term of the step equation of the steering motor 65 represents the slope.

According to the active steering system 30 used in the present invention, as shown in FIG. 10, since the step value of the steering motor 65 with respect to the position (the size of the belt edge signal) of the main scanning direction of the belt 30 can be determined as a fixed value, even when the balance point varies while the belt system operates, stable belt steering can be performed. For example, when the balance point varies with applied pressure to the fusing unit or developing unit, or when the pressure is removed, or jitter caused by feeding thick paper in the image forming apparatus, if the steering motor 65 is moved to the step value corresponding to a new balance point, the edge of the belt 30 is moved to the position corresponding to variations of the position of the step value of the steering motor 65 in the center of the photodetector 53. When the belt 30 is stably controlled in a position deviated from the center of the photodetector 53, the amount of weaving of the belt 30 may slightly increase but mis-registration of images does not occur.

Figure 13:
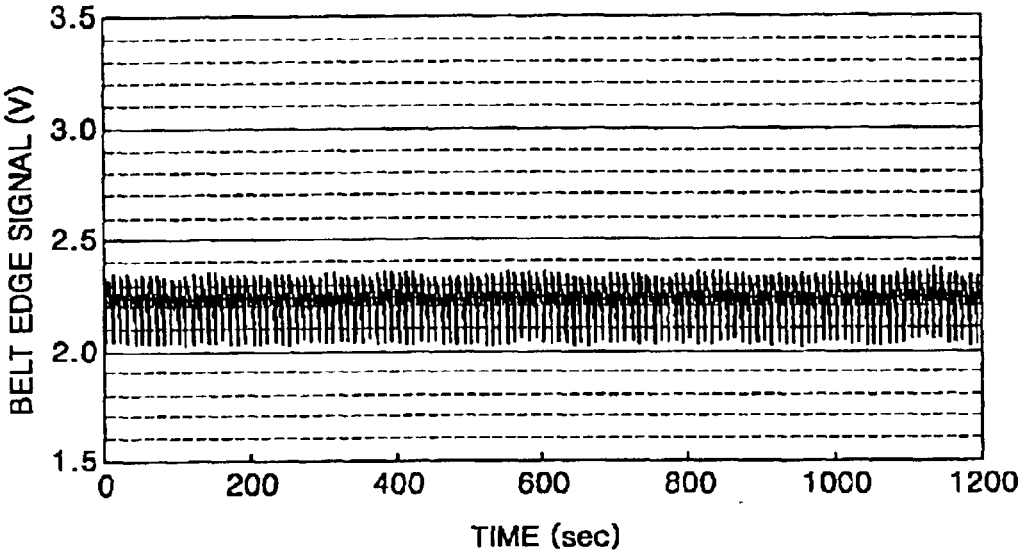
FIG. 13 is a graph illustrating a belt edge signal detected by the belt edge sensor when the steering motor is driven in a step interval of ±0.75.
Figure 14:
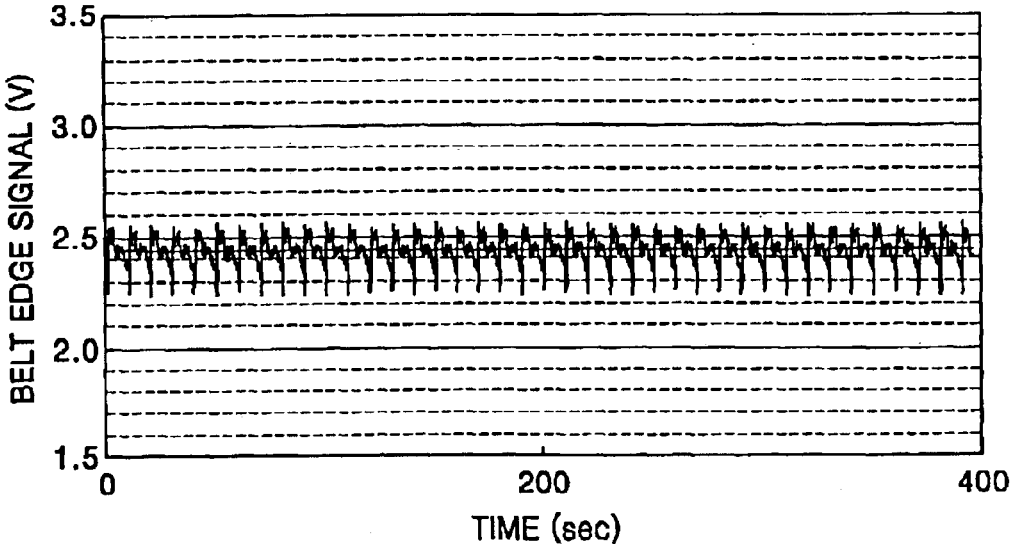
FIG. 14 is a graph illustrating a belt edge signal detected by the belt edge sensor when the steering motor is driven in a step interval in which the relationship between the belt edge signal and a step value of the steering motor satisfies a quadratic functional equation.

FIG. 13 illustrates a belt edge signal when the steering motor 65 is driven in a step interval of 100±0.75 being applied to the graph of 100±0.75 step shown in FIG. 11, and FIG. 14 illustrates a belt edge signal when the steering motor 65 is driven in a step interval of a quadratic coefficient graph as shown in FIG. 11 in which the relationship between the belt edge signal and a step value of the steering motor 65 satisfies a quadratic functional equation. The result of FIGS. 13 and 14 show that the reference belt edge signal $V_o$ is 2.5 Volts when the edge of the belt 30 was placed at the center of the photodetector 53, and the belt edge signal varies 0.1 Volts when the edge of the belt 30 was deviated from the center of the photodetector 53 to 0.1 mm.

In FIG. 13, the belt 30 is controlled in the position that the belt 30 is deviated from the center of the photodetector 53 by 0.25 mm (belt edge signal 2.25 Volts), that is, 2.25 mm position when the center of the photodetector 53 is placed in a 2.5 mm position. This is because the balance point does not have a proper value, but the amount of weaving of the belt 30 is very small, and thus does not affect registration. In FIG. 14, the belt 30 is controlled in the position that the belt 30 is deviated from the center of the photodetector 53 by 0.05 mm (belt edge signal 2.45 Volts), that is, 2.45 mm position when the center of the photodetector 53 is placed in a 2.5 mm position. This is because of an output error of the photodetector 53. As shown in FIGS. 13 and 14, the active steering system 20 can very stably control the position in the widthwise direction of the belt 30 with respect to a new balance point even when the balance point varies.

Here, conditions of experiment for obtaining the results of FIGS. 13 and 14 are as follows. A jointed photoreceptor belt having a length of 32 inches was used as the belt 30. Also, a seam step of a jointed portion was about 330 μm, and a parallel degree was 51 μm. The belt 30 was driven at speed of 3.2-inches per second, and output of the photodetector 53 was averaged for five seconds. The minimum step interval of the steering motor 65 was 0.25 steps at a deceleration ratio of 1:4, and the belt steering roller 33 rotates 0.225° with respect to the minimum step interval of the steering motor 65. PD S6967 manufactured by Hamamatsu Co., Ltd. having a window of 5 mm was used for the photodetector 53. The maximum output (maximum value of the belt edge signal) of the photodetector 53 was 5 Volts such that the size of the belt edge signal varied 1 Volt when the edge of the belt 30 moved 1 mm on the photodetector 53. As seen from the experiment results, there were variations of a maximum voltage of 330 mV because of a seam step. Thus, the maximum amount of weaving of the belt 30, which is not affected by the shape pattern of the belt 30, was 22 μm and 8 μm, respectively, per second. In addition, the amount of weaving of the belt 30 in FIGS. 13 and 14 was 0.013 μm and 0.006 μm, respectively, per second.

This result shows that weaving of the belt 30 almost does not occur, and the amount of weaving of the belt 30 does not affect images when the belt 30 is steered by the active steering system 20 according to the present invention. In addition, the result shows that excellent characteristics may be obtained when the steering motor 65 is adjusted and steered in a step interval in which the relationship between the belt edge signal and the step value of the steering motor 65 satisfies a quadratic functional equation.

Thus, if the belt 30 is steered using the active steering system 20 according to the present invention, weaving of the belt 30, which may cause mis-registration and color mis-registration in images, does not occur. Thus, unlike a conventional registration system, for example, a belt edge synthesizer is not required, the position of the main scanning direction of the belt 30 is strictly controlled, measurement of the position of the belt 30 for determining a scanning start time for each color image is also not required, and thus one belt edge sensor 50 is sufficient. That is, in case of using the active steering system 20, an additional registration correction circuit is not required.

Figure 15:
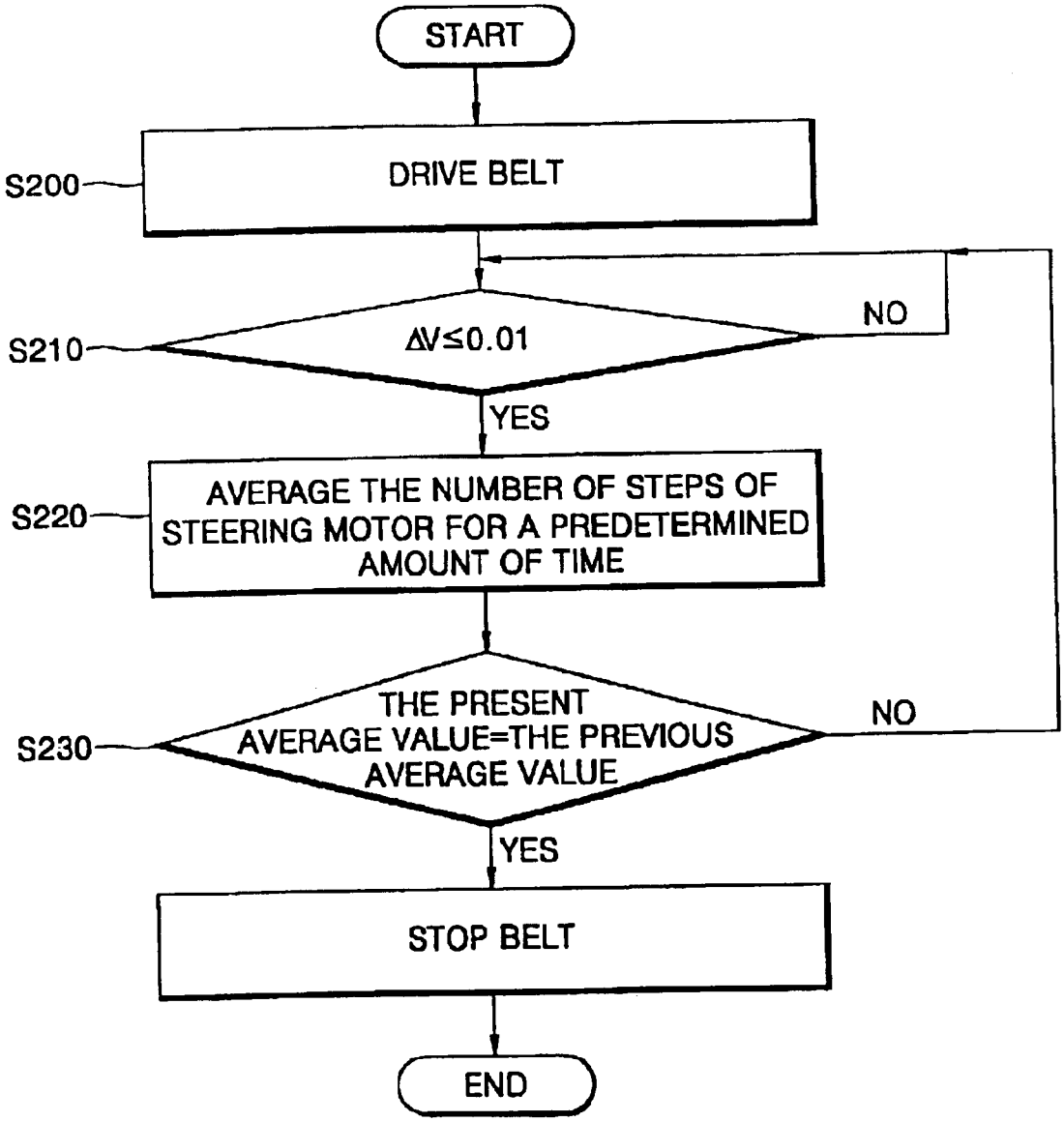
FIG. 15 is a flowchart schematically illustrating a method for searching for a balance point used in an exemplary method for driving a belt according to the present invention.

The balance point for optimal belt steering that can minimize the amount of weaving of the belt 30 is searched for by a process shown in FIG. 15 by an active steering method according to the present invention. The process of searching for the balance point is performed whenever the belt 30 is initially mounted in the belt system or the belt 30 is replaced with another one or the balance point varies.

Referring to FIG. 15, by the control of the main controller 70, the steering motor controller 61 drives the steering motor 65 and the steering roller 33 is moved to a position corresponding to a middle value of the step range of the steering motor 65 or the step value (data stored in the memory 75) corresponding to a previous balance point, and then the driving motor controller 41 drives the driving motor 45 to drive the belt 30 in a progressing direction (S200).

Then, while the belt 30 rotates and is driven, a belt edge signal corresponding to the degree at which the belt 30 shields the photodetector 53 of the belt edge sensor 50 is detected. If the position in the widthwise direction of the belt 30 is adjusted and the amount of variations of the belt edge signal is less than a predetermined value (i.e., 0.01 Volts) (or the amount of variations of the step value of the steering motor 65 is less than a predetermined value when the amount of variations of the belt edge signal is less than a predetermined value)(S210), the number of steps of the steering motor 65 (or belt edge signal) is averaged for a predetermined amount of time (preferably, one rotation cycle of the belt 30)(S220).

It is checked whether the average value of the step number (or belt edge signal) for a predetermined amount of time is the same as the previous average value within an allowable error range. If the average value is not the same as the previous average value, the position in the widthwise direction of the belt 30 is adjusted on the basis of the position (steering position) of the steering roller 33 corresponding to the average value of the number (or belt edge signal) of steps that is presently counted. The processes are performed repeatedly such that the step value of the steering motor 65 is averaged for a predetermined amount of time (preferably, one rotation cycle of the belt 30) until the amount of variations of the belt edge signal output from the belt edge sensor 50 (or the number of steps of the steering motor 65) is less than a predetermined value and the step value of the steering motor 65 is compared with the previous average value. If the counted average value of the number (or belt edge signal) of steps of the steering motor 65 is the same as the previous average value within the allowable error range, the position of the steering roller 33 corresponding to the average value is determined as the balance point, and a process of searching for the balance point stops (S230).

Figure 16:
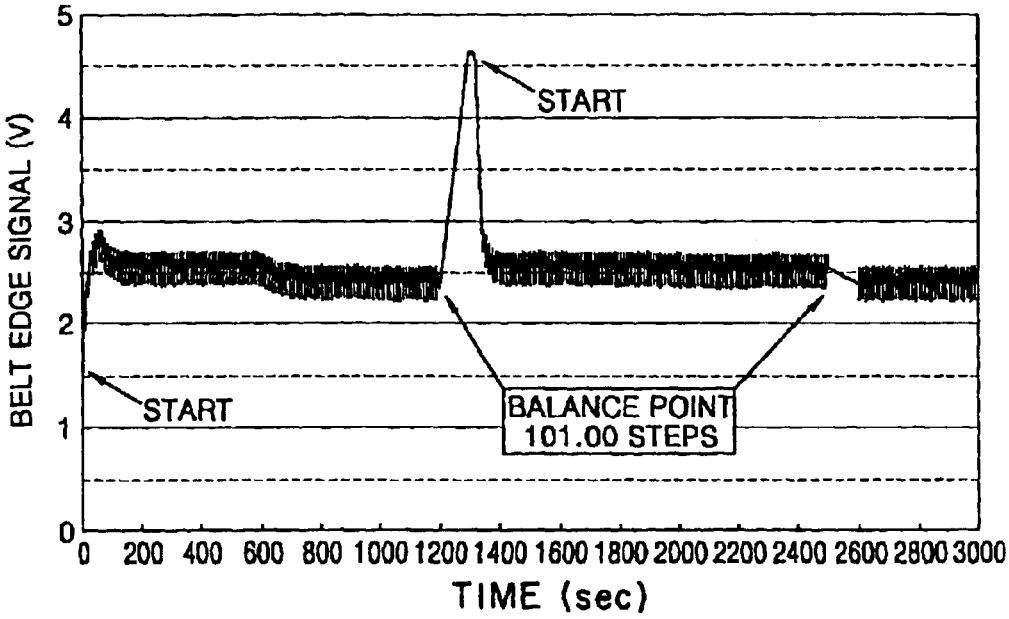
FIG. 16 is a graph illustrating an output of the belt edge sensor when a program of automatically obtaining the balance point using a process described in FIG. 15 is executed.

Output of the belt edge sensor 50 when a program for automatically obtaining the balance point using the above process is executed is shown in FIG. 16. In the graph of FIG. 16, a start portion shows the result in which the balance point is searched for when the edge of the belt 30 is initially placed in the position of 1.5 mm on the photodetector 53. A middle portion shows the result in which the balance point is again searched for after the belt 30 is forcibly placed in the position of 4.6 mm on the photodetector 53. In both cases, the step value of the steering motor 65 at the balance point was 101.00 steps. Meanwhile, the last portion shown in FIG. 16 shows the belt edge signal when the belt 30 is steered with respect to the balance point and is driven after the balance point is searched for.

As described previously, the belt system being applied to the active steering system 20 used in the present invention may include at least one sub-unit that affects the balance point in which the amount of weaving of the belt 30 is minimized.

In the case of the image forming apparatus using a photoreceptor belt, due to the driving of various sub-units, such as the pressure of a transfer roller (37 of FIG. 3), lift-up of a developing unit, or feeding thick paper and/or contact of a cleaning unit after a print job starts, the balance point of driving of the photoreceptor belt varies, and thus weaving of the photoreceptor belt occurs.

As known from the description of FIG. 10, the number of steps of the steering motor 65 can be determined as a fixed value according to the position of the belt 30. Thus, if the belt 30 is steered using the active steering system 20 as described previously, the belt 30 can be stably steered at a new balance point such that by the pressure of the sub-unit, for example, a transfer roller, even when the balance point varies, the steering of the belt 30 is almost not affected by the varied balance point.

Weaving of the belt 30 occurring, for example, during the pressure and/or release of the sub-unit may lead to serious functional problems.

Thus, when the active steering system 20 measures in advance balance points that vary with the operation of various sub-units and stores them in the memory 75, and when at least one sub-unit operates after the belt 30 is driven, the belt 30 is steered so that weaving of the belt 30 caused by variations of the balance points is prevented by properly changing the balance points, thereby preventing weaving of the belt 30. In this case, belt steering under each operation is performed while the edge of the belt 30 is placed in a predetermined position on the photodetector 53, i.e., at the center of the photodetector 53.

If active steering with respect to the belt 30 is performed with taking into consideration variations of the balance point caused by the operation of at least one sub-unit, even during pressure and/or release of the at least one sub-unit, the amount of weaving of the belt 30 can be controlled to be less than several microns, and thus an additional registration correction unit is not required.

Here, preferably, the process of searching for the balance point, which varies during pressure and/or release of the at least one sub-unit, is performed whenever the belt 30 is initially mounted in the belt system, the belt 30 is replaced with another one, the balance point is changed, or conditions of applied pressure to the sub-unit are changed.

The active steering technique as described above can be employed in the belt system employing at least one belt and thus can be used to steer the belt.

For example, the active steering system 20, as shown in FIG. 3, can be used to control the position of the main scanning direction of the photoreceptor belt. Besides, the active steering system 20 can be used to steer at least one belt of a transfer belt, a drying belt, a fusing belt, a returning belt and an oil supplying unit of a fusing unit, and a cleaning roller using a belt. Here, a structure, in which at least one belt of a transfer belt, a drying belt, a fusing belt, and a returning belt is embedded, is well-known, and a process of controlling the position in the widthwise direction of the belt 30 using the active steering system 20 according to the present invention is substantially the same as described previously. Thus, their descriptions will be omitted.

As described above, the belt system according to the present invention can be used in image forming apparatuses such as printers, copiers, and facsimiles and also in various fields.

In the method for driving a belt according to the present invention, the steering roller is first placed in the home position, and the belt is driven while the steering roller is placed in the final position that corresponds to the previously driven position of the belt 30 or at the balance point in which the amount of weaving of the belt is minimized on the basis of the home position. Thus, the amount of initial weaving of the belt when the belt is driven can be minimized such that a time until images with suitable registration are obtained, when the belt is driven so as to form images, can be greatly reduced.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A method of driving a belt, the method comprising:

searching for a home position of a steering roller, the steering roller being operative to adjust a position of the belt in a widthwise direction;

placing the steering roller in the home position; and moving the steering roller from the home position to a balance point so that an amount which the belt varies in the widthwise direction is less than a predetermined value, or moving the steering roller to a position which corresponds to a final position of the steering roller obtained when the belt was previously driven, wherein an amount of initial weaving of the belt when the belt is driven is reduced.

2. The method of claim 1, wherein the belt is actively steered with respect to the balance point while the belt rotates and is driven.

3. The method of claim 1, further including a steering motor for driving the steering roller, wherein an initial driving speed of the steering motor when searching for the home position of the steering roller is slower than a driving speed of the steering motor when the amount of weaving of the belt is controlled so that variations of the position of the belt are reduced.

4. The method of claim 1, further comprising storing position information of the steering roller.

5. The method of claim 4, wherein storing the position information of the steering roller is performed at predetermined time intervals while the belt is driven.

6. The method of claim 4, further comprising comparing the final position information of the steering roller which corresponds to the previously driven position of the belt with the home position and determining a driving direction of the steering motor such that an amount of adjustment of the steering motor to place the steering roller in the home position is reduced.

7. The method of claim 1, wherein a process of searching for the balance point is performed when a new belt is mounted in a belt system, the belt is replaced with another one, or the balance point is changed.

8. The method of claim 7, further including a steering motor for driving the steering roller, wherein when an average value for a predetermined amount of time of a step value of the steering motor does not vary within a predetermined error range, a position corresponding to the average value is determined as the balance point.

9. The method of claim 1, wherein the belt includes one of a photoreceptor belt, a transfer belt, a drying belt, a fusing belt, and a returning belt.

10. The method of claim 1, wherein said searching for the home position of the steering roller is done before the belt is driven.

11. The method of claim 1, wherein the home position is a position of the steering roller along a range of motion of the steering roller.

12. The method of claim 1, wherein the belt is not driven during the searching for the home position.

13. The method of claim 1, wherein a steering motor provides a force to move a gear and the steering roller, the gear having a mark that is used to detect the home position.

14. The method of claim 1, wherein the home position is a center of maximum movement of the steering roller.

15. An apparatus for driving a belt, the apparatus comprising:

a steering roller that is operative to adjust a position of the belt in a widthwise direction;

means for searching for a home position of the steering roller;

means for placing the steering roller in the home position; and means for moving the steering roller from the home position to a balance point so that an amount that the belt varies in the widthwise direction is less than a predetermined value, or for moving the steering roller to a position which corresponds to a final position of the steering roller obtained when the belt was previously driven, wherein an amount of initial weaving of the belt when the belt is driven is reduced.

16. The apparatus of claim 15, further including means for actively steering the belt with respect to the balance point while the belt rotates and is driven.

17. The apparatus of claim 15, further comprising means for storing position information of the steering roller.

18. The apparatus of claim 17, wherein storing the position information of the steering roller is performed at predetermined time intervals while the belt is driven.

19. The apparatus of claim 17, further comprising means for comparing the final position information of the steering roller that corresponds to the previously driven position of the belt with the home position and determining a driving direction of the steering motor such that the amount of adjustment of the steering motor to place the steering roller in the home position is reduced.

20. The apparatus of claim 15, wherein the means for moving the steering roller from the home position to a balance point is performed when a new belt is mounted in a belt system, the belt is replaced with another one, or the balance point is changed.

21. The apparatus of claim 15, wherein the belt includes one of a photoreceptor belt, a transfer belt, a drying belt, a fusing belt, and a returning belt.

22. The apparatus of claim 15, wherein the home position is a position of the steering roller along a range of motion of the steering roller.

23. The apparatus of claim 15, wherein the belt is not driven when the means for searching searches for the home position.

24. The apparatus of claim 15, wherein a steering motor provides a force to move the gear and a steering roller, the gear having a mark that is used to detect the home position.

25. The apparatus of claim 15, wherein the home position is a center of maximum movement of the steering roller.

* * * * *